US008066023B2

(12) United States Patent
Hoffart

(10) Patent No.: US 8,066,023 B2
(45) Date of Patent: Nov. 29, 2011

(54) SYSTEM AND METHOD FOR COLLECTING AND INCREASING THE PRESSURE OF SEAL LEAK GAS

(75) Inventor: Shawn D. Hoffart, Overland Park, KS (US)

(73) Assignee: Black & Veatch Corporation, Overland Park, KS (US)

( * ) Notice: Subject to any disclaimer, the term of this patent is extended or adjusted under 35 U.S.C. 154(b) by 994 days.

(21) Appl. No.: 11/786,398

(22) Filed: Apr. 10, 2007

(65) Prior Publication Data

US 2008/0251129 A1 Oct. 16, 2008

(51) Int. Cl.
*F17D 1/02* (2006.01)

(52) U.S. Cl. ..... 137/14; 137/312

(58) Field of Classification Search ..... 137/312, 137/1, 14; 73/46, 40.7, 863.73
See application file for complete search history.

(56) References Cited

U.S. PATENT DOCUMENTS 4,840,195 A * 6/1989 Zabrenski ..... 137/312
6,029,506 A * 2/2000 Dilger ..... 73/46
6,484,745 B1 * 11/2002 Navarro ..... 137/312

OTHER PUBLICATIONS

*Chemical Engineer's Handbook, Third Edition,* Perry, John H. PhD, Editor, McGraw-Hill Book Company, Inc., 1950 pp. 1285.

* cited by examiner

*Primary Examiner* — Kevin Lee
(74) *Attorney, Agent, or Firm* — F. Lindsey Scott

(57) ABSTRACT

A system and a method for recovering and increasing the pressure of seal leak gas for recycle or passage to further processing.

19 Claims, 2 Drawing Sheets

SYSTEM AND METHOD FOR COLLECTING AND INCREASING THE PRESSURE OF SEAL LEAK GAS

FIELD OF THE INVENTION

The present invention relates to a system and a method for recovering and increasing the pressure of seal leak gas for recycle or passage to further processing.

BACKGROUND OF THE INVENTION

In many industrial processes it is necessary that gases be compressed. Typically turbine compressors, centrifugal compressors, pumps, screw compressors and the like may be used for this purpose. Such equipment is referred to herein generally as compressors. The compressors typically include seals for the passage of rotary components through sidewalls, ends or the like of the compressors. These seals are typically designed to permit leakage of small amounts of compressed gases through the seal. Many times the passage of the gas is due to wear of the seal but in many instances seals are designed to permit leakage of a selected quantity of gas in normal operation.

The seal leak gas in many instances may be harmful to the environment or constitute a valuable product which is desired to be recovered. In either event, it is typically recovered by positioning covers over the seal areas to sealingly contain the area around the seal with the cover positioned so that the seal leak gas is collected inside the cover. The cover may include a passageway, including a seal, for a rotary component passing through the cover into the compressor. Covers can be of a wide variety of configurations so long as they are effective to sealingly contact the unit containing the seal so that the gas is recovered in the cover. The cover typically has included a line for the passage of the gas into the atmosphere or more frequently to a stack or the like where the gas can be burned or passed to a gas processing system. The seal at the passageway does not present a leakage problem since the gas inside the cover is typically at a low pressure.

Since this seal gas is at relatively low pressures, it typically does not flow readily to further treatment. Usually the seal gas is vented or combusted at atmospheric or near atmospheric pressure. Accordingly, a pump or a fan system is typically required to move the seal leak gas to a treatment area, stack area, or the like if the system is at any level of positive pressure. It is difficult to economically recompress the gas for reuse, if it is a desirable gas. The economics dictate that the gases be sent to a flare for burning or the like even if they are valuable in view of the expense to recover the gases and pass them back for reuse.

Accordingly, a continuing search has been directed to the development of a method and system for economically collecting such gases and increasing their pressure so that they may be either reused or readily passed to further treatment.

SUMMARY OF THE INVENTION

According to the present invention, a system is provided for collecting seal leak gas and increasing the pressure of the seal leak gas, the system comprising: at least one source of seal leak gas having a gas inlet at a first pressure and a pressurized gas outlet at a second pressure and including at least one seal having a gas leak; a cover positioned to collect seal leak gas from at least one gas leak from the source and having a seal leak gas outlet; a venturi having a pressurized gas inlet at a third pressure, a mixed gas outlet at a fourth pressure and a seal leak gas inlet; a first line in fluid communication with the gas outlet and with the pressurized gas inlet; and, a second line in fluid communication with the at least one gas leak and the seal leak gas inlet to produce a mixed gas through the mixed gas outlet at the fourth pressure, the fourth pressure being greater than the first pressure.

The invention further includes a method for collecting seal leak gas from leaks at seals in compression equipment and increasing the pressure of the seal leak gas, the method comprising: compressing an inlet gas stream at a first pressure in the compressor equipment to produce a compressed gas stream at a second pressure; collecting seal leak gas from at least one seal in the compressor equipment; passing a minor amount of the compressed gas stream through a venturi to create a reduced pressure inlet into the venturi; and, passing the seal leak gas to the reduced pressure inlet to produce a mixed gas stream at a third pressure, the third pressure being greater than the first pressure.

DESCRIPTION OF PREFERRED EMBODIMENTS

In the discussion of the Figures, the same numbers will be used throughout to refer to the same or similar components. Many valves, controls and the like which will be necessary in the practice of the present invention have not been shown since the use of these components and the components themselves are well known and do not require further description for the disclosure of the present invention.

The present invention is useful with a compression system which may include compressors, i.e., either axial, positive displacement, centrifugal, screw, and the like or simply pumps, which pump gas from a first pressure to a second higher pressure. In such instances there are seals involved in the equipment which may be designed to leak controlled amounts of seal leak gas through the seal either for purposes of cooling or the like. In other instances the leakage is the result of simple wear. In any event, according to the present invention, the seal leak gases are collected by the use of covers over the seal areas to recover the escaping seal leak gas. The compression system is used to increase the pressure of a gaseous stream. According to the present invention, a small slip stream of the compressed stream is withdrawn and passed through a venturi which enables the suction of the seal leak gas into the venturi for mixture with the higher pressure slip stream. The recovered mixed gas stream is at a significantly higher pressure than the seal leak gas and is readily passed back to the inlet to the compressor so that both the slip stream and the seal leak gas may be recovered.

Figure 1:
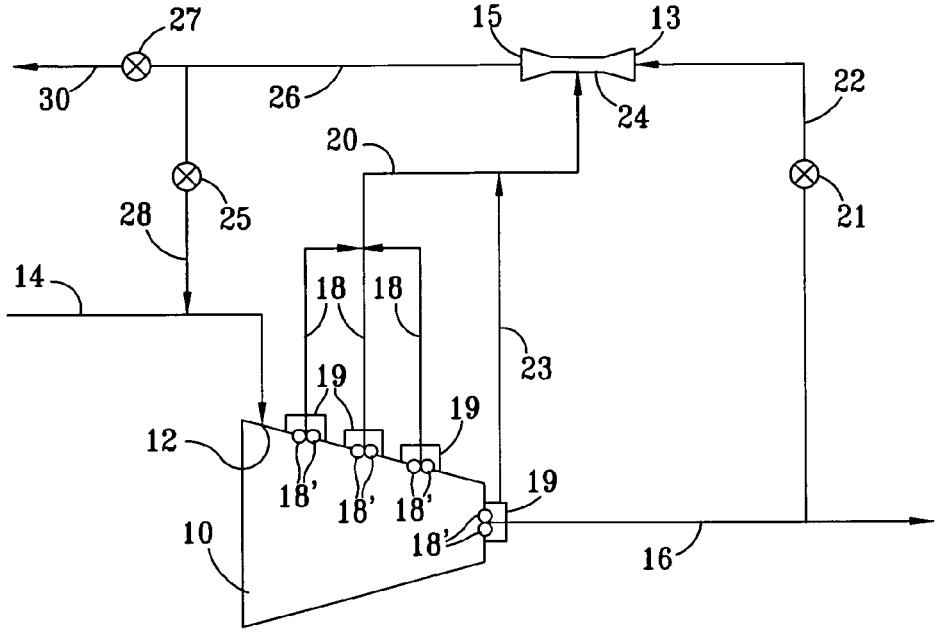
FIG. 1 is a schematic diagram of a system for the practice of a method for recovering seal leak gas, recompressing the gas and returning it economically and efficiently to the inlet of a compressor, according to the present invention.

The invention is shown in FIG. 1, which shows a compressor 10 having a gas inlet 12 fed by a gas line 14. A compressed gas outlet 16 is shown and represents a compressed gaseous stream. Seal leak gas escaping the compression system is shown through a plurality of lines 18, line 23 and a line 20, having seals 18'. Line 20 via covers 19 is connected to venturi 24 which enables the suction of the seal leak gas into the venturi for return to the process as described. In venturi 24 a slip stream from high pressure line 22 is mixed with the seal leak gas from line 20 and passed through a line 26 and a line 28 to line 14. A line 30 is shown to indicate that the compressed gas may be passed to other treatment, such as flaring and the like. Valves 21, 25 and 27 regulate flow through lines 22, 28 and 30. Particularly in processes, such as processes for the liquefaction of natural gas, the lost gas is a valuable mixed refrigerant. The use of the present invention allows the recovery and return of this mixed refrigerant to the process. The application of the present invention is by no means limited to mixed refrigerants but can be used with any gas pumped through a compression system where it is desirable to recover the seal leak gas.

Figure 2:
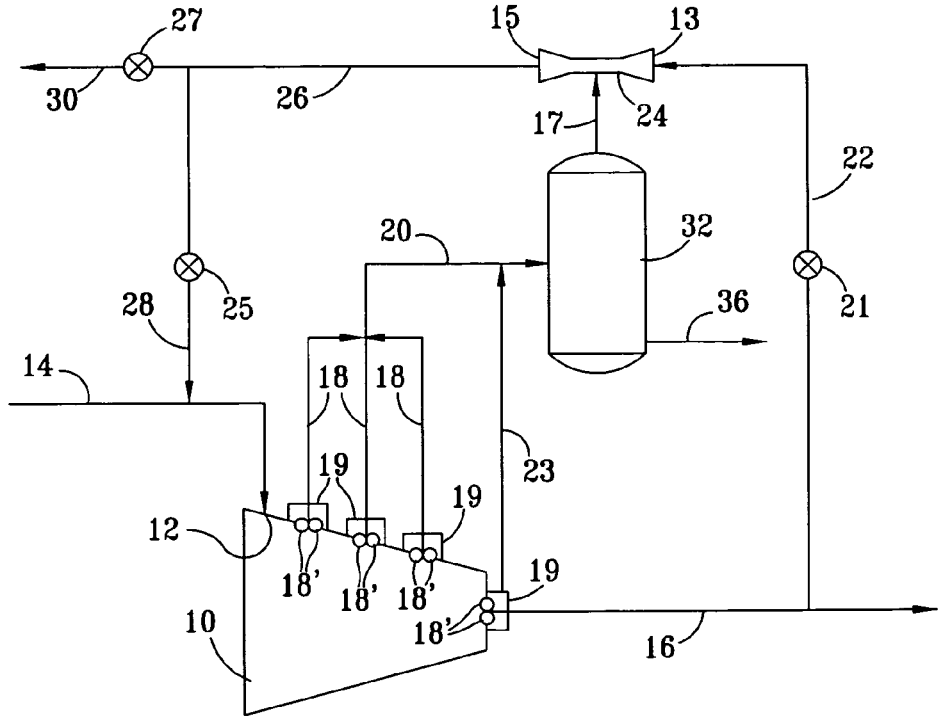
FIG. 2 is a schematic diagram of an alternative embodiment of the present invention wherein a separation zone is used to separate undesirable liquid and/or solid components from a seal leak gas stream; and, FIG. 3 is a schematic diagram of the use of the method and system of the present invention in conjunction with a natural gas liquefaction process.

In FIG. 2 a similar embodiment is shown but line 20 passes the seal leak gas to a separator 32 where liquids and solids can be separated from the seal leak gas with the solids and liquids being recovered through line 36 and the seal leak gases being passed via a line 34 to venturi 24. Vessel 32 may also be employed as a surge vessel, allowing storage of the seal leak gas for a period of time with no flow passing through lines 22 and 26. At an appropriate time, flow can be established through lines 22 and 26 to recover the seal leak gas stored in vessel 32. Seals 18' and covers 19 are positioned on lines 18 and 23 and valves 25 and 27 have been shown in lines 28 and 30.

Venturi systems are considered to be extremely well known as shown for instances in *Chemical Engineer's Handbook, Third Edition*, Perry, John H. PhD, Editor, McGraw-Hill Book Company, Inc., 1950 pp. 1285.

Figure 3:
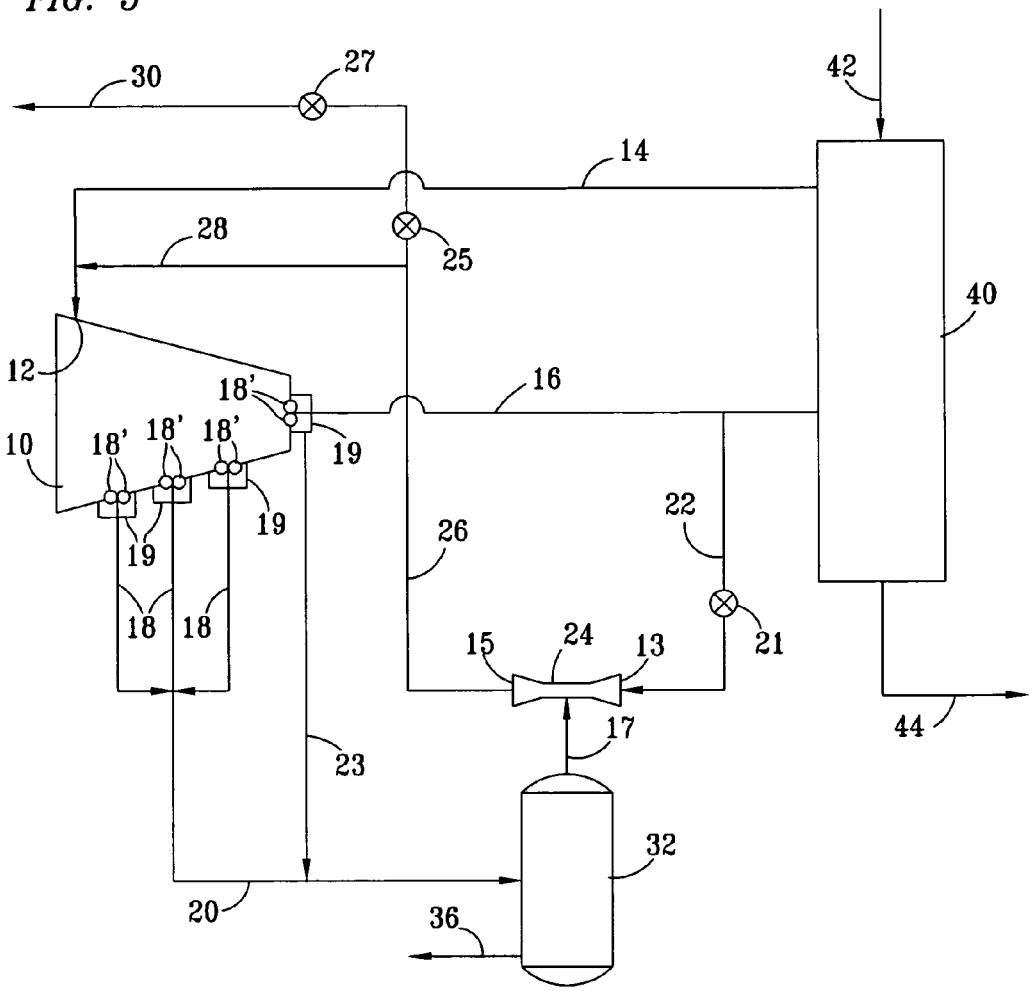

In FIG. 3 a schematic diagram of the use of the present invention in combination with a natural gas liquefaction process is shown. A gas liquefaction facility 40 is shown having a natural gas inlet 42 and a liquefied natural gas outlet 44. In this embodiment inlet gas stream 14 is the spent refrigerant from the gas liquefaction facility 40 with the compressed stream in line 16 comprising the compressed refrigerant for use in the gas liquefaction facility. It is well known to those skilled in the art that such compressed gas typically requires cooling prior to passing it to the gas liquefaction facility or in the gas liquefaction facility so that the compressed, cooled refrigerant may be vaporized to provide cooling in the gas liquefaction facility. Many such processes are known to those skilled in the art and the present invention is considered to be suitable for use with all such processes since it primarily relates to the recovery and repressurization of seal leak gas from the compression system.

The system of the present invention may include a plurality of compression units and the venturi can receive seal leak gas from a plurality of seals. The seals may be contained either in a single unit or a plurality of units. All such embodiments are considered suitable for the recovery of the seal leak gas by means well known to those skilled in the art. In other words, such gas streams have previously been recovered for treatment by either flaring or the like. The same collection system for the gases can be used for the present invention with the difference being the recovery of the gases for passage to the venturi so that the seal leak gases can be recovered at a sufficient pressure for reinjection into the system or passage to other treatment.

According to the present invention, the pressure of the gas stream in line 22 is at or slightly below the pressure in line 16 and flows through venturi 24, drawing seal leak gas from line 20 into the gas stream from line 22 to produce a mixed gas stream which is recovered through line 26 at a pressure somewhat lower than the pressure in line 22 but greater than the pressure in line 14. Wide variations in the process pressures are possible so long as the relationship between the pressures is maintained as described above. For instance, in processes for the liquefaction of natural gas the pressure of the refrigerant (line 16) may be relatively high (200 to about 1000 psi) and the pressure of the returned, spent refrigerant (line 14) may be relatively low (0 to about 200 psi). It is clear that when a slipstream of gas is taken through line 22 in an amount sufficient to produce the desired suction from line 20, either directly or via separator 32, that the pressure of the mixed stream will be well above the pressure in line 14. The flow of high pressure gas through line 22 is desirably regulated by a valve 21 as known to those skilled in the art. The flow through line 22 will typically be limited to only that amount necessary to produce the required suction and the required pressure in line 26. Since this gas is recovered along with the seal leak gas, there is no net loss of gas to the process. Further there is no requirement for additional compression equipment with the resulting maintenance and power requirements.

While the present invention has been described above primarily with respect to natural gas liquefaction processes, it is equally useful with other processes, such as pumping stations for gaseous products of various kinds. The present invention can generally be used in any process in which a gaseous stream is compressed and which experiences the loss of gas through seals.

While the present invention has been described by reference to certain of its preferred embodiments, it is pointed out that the embodiments described are illustrative rather than limiting in nature and that many variations and modifications are possible within the scope of the present invention. Many such variations and modifications may be considered obvious and desirable by those skilled in the art based upon a review of the foregoing description of preferred embodiments.

What is claimed is:

1. A system for collecting seal leak gas and increasing the pressure of the seal leak gas, the system comprising:

a) at least one source of seal leak gas having a gas inlet (14) at a first pressure and a pressurized gas outlet at a second pressure and including at least one seal having seal gas leak;

b) a cover positioned to collect seal leak gas from at least one seal gas leak from the source and having a seal leak gas outlet;

c) a venturi having a pressurized gas inlet at a third pressure, a mixed gas outlet at a fourth pressure and a seal leak gas inlet;

d) the source being in fluid communication with the pressurized gas inlet and the mixed gas outlet and a third line in fluid communication with the venturi mixed gas outlet and the gas inlet; and, e) a second line in fluid communication with the at least one gas leak and the seal leak gas inlet to the venturi produce a mixed gas through the mixed gas outlet at the fourth pressure, the fourth pressure being greater than the first pressure.

2. The system of claim 1 wherein the source is a gas compressor.

3. The system of claim 1 wherein the cover sealingly covers the gas leak.

4. The system of claim 1 wherein the first line includes a valve to control the amount of gas passed from the gas outlet to the pressurized gas inlet.

5. The system of claim 1 wherein a line is positioned from the cover to an inlet to a separator vessel and wherein a line is positioned from an outlet from the separator vessel to the seal leak gas inlet.

6. The system of claim 1 wherein the mixed gas is passed through a line from the mixed gas outlet to further treatment.

7. The system of claim 1 wherein the source is a pump.

8. A method for collecting seal leak gas from leaks at seals in compression equipment and increasing the pressure of the seal leak gas, the method comprising:

a) compressing an inlet gas stream at a first pressure in the compressor equipment to produce a compressed gas stream at a second pressure;

b) collecting seal leak gas from seals in the compressor equipment;

c) passing an amount of the compressed gas stream necessary to produce the required suction through a venturi to create a reduced pressure inlet into the venturi; and, d) passing the seal leak gas to the reduced pressure inlet to produce a mixed gas stream at a third pressure, the third pressure being greater than the first pressure.

9. The method of claim 8 wherein the mixed gas stream is passed to further treatment.

10. The method of claim 8 wherein the mixed gas stream is passed to combination with the inlet gas stream.

11. The method of claim 10 wherein the inlet gas is a refrigerant for a cooling process.

12. The method of claim 11 wherein the inlet gas is a single component refrigerant.

13. The method of claim 11 wherein the cooling process is a process for liquefying a natural gas stream.

14. The method of claim 8 wherein the seal leak gas is passed to a separator for the separation of liquids or solids from the seal leak gas prior to passing the seal leak gas to the reduced pressure inlet.

15. The method of claim 8 wherein the inlet gas is natural gas.

16. The method of claim 8 wherein the seal leak gas is collected from a plurality of compressor units.

17. The method of claim 8 wherein the inlet gas is a multi-component refrigerant.

18. The method of claim 17 wherein the refrigerant is used in a cascade natural gas liquefaction process.

19. The method of claim 17 wherein the refrigerant is used in a multi-component refrigerant natural gas liquefaction process.

* * * * *